US007793644B2

(12) United States Patent
Lai

(10) Patent No.: US 7,793,644 B2
(45) Date of Patent: Sep. 14, 2010

(54) FIRING MECHANISM FOR PAINTBALL GUN

(76) Inventor: Bao Shyan Lai, No. 839, Wunsin S. Rd., Nantun District, Taichung City 408 (TW)

( * ) Notice: Subject to any disclaimer, the term of this patent is extended or adjusted under 35 U.S.C. 154(b) by 437 days.

(21) Appl. No.: 12/010,893

(22) Filed: Jan. 30, 2008

(65) Prior Publication Data

US 2010/0012109 A1 Jan. 21, 2010

Related U.S. Application Data

(63) Continuation-in-part of application No. 11/483,620, filed on Jul. 11, 2006, now Pat. No. 7,448,372.

(51) Int. Cl.
*F41B 11/00* (2006.01)

(52) U.S. Cl. ..... 124/77; 124/73; 124/75

(58) Field of Classification Search ..... 124/70–77
See application file for complete search history.

(56) References Cited

U.S. PATENT DOCUMENTS

| | | | | |
|---|---|---|---|---|
| 2,881,752 | A * | 4/1959 | Blahnik | 124/75 |
| 4,850,330 | A * | 7/1989 | Nagayoshi | 124/76 |
| 4,936,282 | A * | 6/1990 | Dobbins et al. | 124/74 |
| 5,078,118 | A * | 1/1992 | Perrone | 124/74 |
| 5,349,938 | A * | 9/1994 | Farrell | 124/73 |
| 5,769,066 | A * | 6/1998 | Schneider | 124/75 |
| 5,778,868 | A * | 7/1998 | Shepherd | 124/76 |
| 6,601,780 | B1 * | 8/2003 | Sheng | 239/337 |
| 6,644,295 | B2 * | 11/2003 | Jones | 124/77 |
| 7,185,646 | B2 * | 3/2007 | Jones | 124/74 |
| 7,461,646 | B2 * | 12/2008 | Jones | 124/77 |
| 7,591,262 | B2 * | 9/2009 | Jones et al. | 124/77 |
| 7,617,819 | B2 * | 11/2009 | Jones | 124/74 |
| 7,617,820 | B2 * | 11/2009 | Jones | 124/77 |
| 7,640,925 | B2 * | 1/2010 | Jones | 124/77 |
| 7,640,926 | B2 * | 1/2010 | Jones | 124/73 |
| 7,640,926 | B2 * | 1/2010 | Jones | 124/74 |
| 2009/0095271 | A1 * | 4/2009 | Jones | 124/77 |

* cited by examiner

*Primary Examiner*—Troy Chambers
(74) *Attorney, Agent, or Firm*—Wang Law Firm; Li K. Wang

(57) ABSTRACT

A firing mechanism for a paintball gun is received in the path of the barrel and a trigger is used to activate the firing mechanism. The firing mechanism includes a driving member, a switch member, a control member and an inner part, all of which are received in the path of the barrel. The driving member drives the switch member to change the air flow in the marker so as to move the control member axially to control the high pressurized air to move the inner part such that the high pressurized air is released to eject the paintballs out from the barrel.

6 Claims, 7 Drawing Sheets

FIRING MECHANISM FOR PAINTBALL GUN

CROSS-REFERENCE TO RELATED APPLICATION

The application is a Continuation-In-Part of Ser. No. 11/483,620, filed on Jul. 11, 2006 now U.S. Pat. No. 7,448,372, and entitled "SHOOTING STRUCTURE OF A PAINT BULLET GUN".

FIELD OF THE INVENTION

The present invention relates to a firing mechanism for a paintball gun and the inner part and the firing mechanism are activated by the same pressurized air source.

BACKGROUND OF THE INVENTION

There are two types of firing mechanism for paintball guns and one of which uses mechanical way to fire the paintballs and the other uses electric way to fire the paintballs. The markers include an inner part which his moved axially in the barrel to open and close the paintball inlet and a firing mechanism is used to activate a valve to introduce pressurized air into the barrel to shoot the paintballs.

A conventional paintball gun 90 is shown in FIG. 7, and generally includes a barrel 9 and a handle 8, the barrel 9 includes an action space and a bore 92 which communicates with a paintball inlet 93 through which paintballs are provided into the bore 92. A cylinder 94 is located in an action space 91 in the marker 90 and adjacent to the bore 92, the cylinder 94 includes a movable tube 95 so as to open or close the paintball inlet 93. The movable tube 95 includes a path 951 and an air storage member 81 and a valve 82 are located beside the cylinder 94. An end cap 96 seals a rear end of the action space 91. The air storage member 81 includes an air storage space 83 which includes a narrowed central path 84 and the central path 84 extends into the path 951 of the movable tube 95. The valve 82 includes a valve rod 85 which is controlled by the valve 82 and includes a seal end 86 at a front end thereof so as to seal the conjunction of the air storage space and the central path 84. The valve rod 85 includes a passage 87 which communicates with the air storage space 83. The end cap 96 includes an air inlet 961 which is connected with a pressurized air source and the passage 87. The handle 8 includes a trigger 89 which is connected with a circuit board 88 so as to control an electro-magnetic valve to control the movement of the valve rod 85.

When the valve rod 85 is moved, the seal end 86 seals the conjunction of the air storage space 83 and the central path 84, the pressurized air then enters the air storage space 83 via the passage 87 to move the movable tube 95 to seal the paintball inlet 93. The user then controls the trigger 89 to move the valve rod 85 to move backward so that the seal end 86 is removed from the conjunction of the air storage space 83 and the central path 84. The pressurized air in the air storage space 83 then enters into the bore 92 via the central path 84 to drive the paintball out from the marker 90. After the paintball is shot, the movable tube 95 moves backward and the second paintball enters the paintball inlet 93 and ready to fire.

It is noted that the movable tube 95 and the valve rod 85 are activated by two different pressurized air sources and this requires a precision arrangement of the movable tube 95 and the valve rod 85, and complicated paths and sophisticate valve which is easily damaged during action. Therefore, a high cost is needed.

Besides, the seal end 86 is used to seal or close the air storage space 83, so that the alignment of the seal end 86 and the central path 84 of the air storage space 83 has to be precisely arrangement or leak happens. Furthermore, the valve rod 85 has a long section located in the air storage space 83 without any support and might be inclined if its rear end is not moved smoothly. This causes that the air storage space 83 cannot be well sealed Furthermore, the inner part and the valve rod 85 are both moved axially in the marker 90 and a longer marker 90 is required.

The present invention intends to provide a firing mechanism for a paintball gun and the inner part and the firing mechanism are activated by the same pressurized air source. By the arrangement, the paintball gun does not need complicated vales and paths, and the paths are switched by using a simple switch member so that the paintball gun can be manufactured at low cost.

SUMMARY OF THE INVENTION

The present invention relates to a paintball gun and comprises a barrel having an axial path which includes a closed end and an opening in the other end. A bore is connected with the opening and a paintball inlet communicates with the path. A first section and a second section are defined in the path and located opposite to the opening. A conjunction opening is defined in the conjunction portion between the first and second sections. A firing mechanism is located in the first and second sections. A stop shoulder is defined in an end of the first section and located opposite to the conjunction opening. A storage space is defined in a side of the path and a pressurized air source provides pressurized air to be stored in the storage space. The storage space communicates with the first and second sections. A handle is connected to the barrel and has a trigger which activates the firing mechanism. The firing mechanism includes a switch member, a control member and an inner part. The inner part is located in the first section in the path and movable axially in the path. The inner part includes an axial space which has one opening end communicating with the path and the other open end of the axial space communicates with the conjunction opening of the first section.

A flange extends outward from the inner part and located beside the conjunction opening and has a first push surface facing the conjunction opening and a second push surface on the opposite side of the first push surface which is stopped by the stop shoulder of the first section. The first push surface has an area larger than that of the second push surface. The flange defines an annular space between an outer periphery of the inner part and an inner periphery of the first section. The annular space communicates with the storage space, and the conjunction opening communicates with the storage space.

The control member is located in the second section of the path and movable axially in the path. The control member has a guide protrusion extending toward the axial space. The guide protrusion includes an air guide end on one end to guide air into the axial space. The control member has an end surface facing the switch member and the other side of the end surface is a stop surface which seals or opens the conjunction opening.

The switch member is fixed to the second section and faces the end surface of the control member. The switch member includes an air path which has one end communicating with an end surface of the switch member. The end surface of the switch member faces the end surface of the control member and forms a first end. The other end of the air path communicates with the storage space and forms a second end. The air path controls the first end to be opened or closed.

The primary object of the present invention is to provide a paintball gun wherein the pressurized air for activating the inner part and the control member comes from the same storage space so that the paintball gun can be a compact paintball gun. No complicated paths or valves are needed and a simple switch member is used to switch the inner part and the control member.

Another object of the present invention is to provide a paintball gun wherein the air located around the inner part is sent back to the storage space by the second push surface of the flange of the inner part when the inner part is moved forward. The air can be saved and increases the number shoots.

Yet another object of the present invention is to provide a paintball gun wherein the control member is supported by the inner periphery of the second section and the guide protrusion of the control member is supported by the inner part so that the control member can precisely seal the conjunction opening.

The control member also supports the movement of the inner part so as to reduce the axial length of the barrel.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
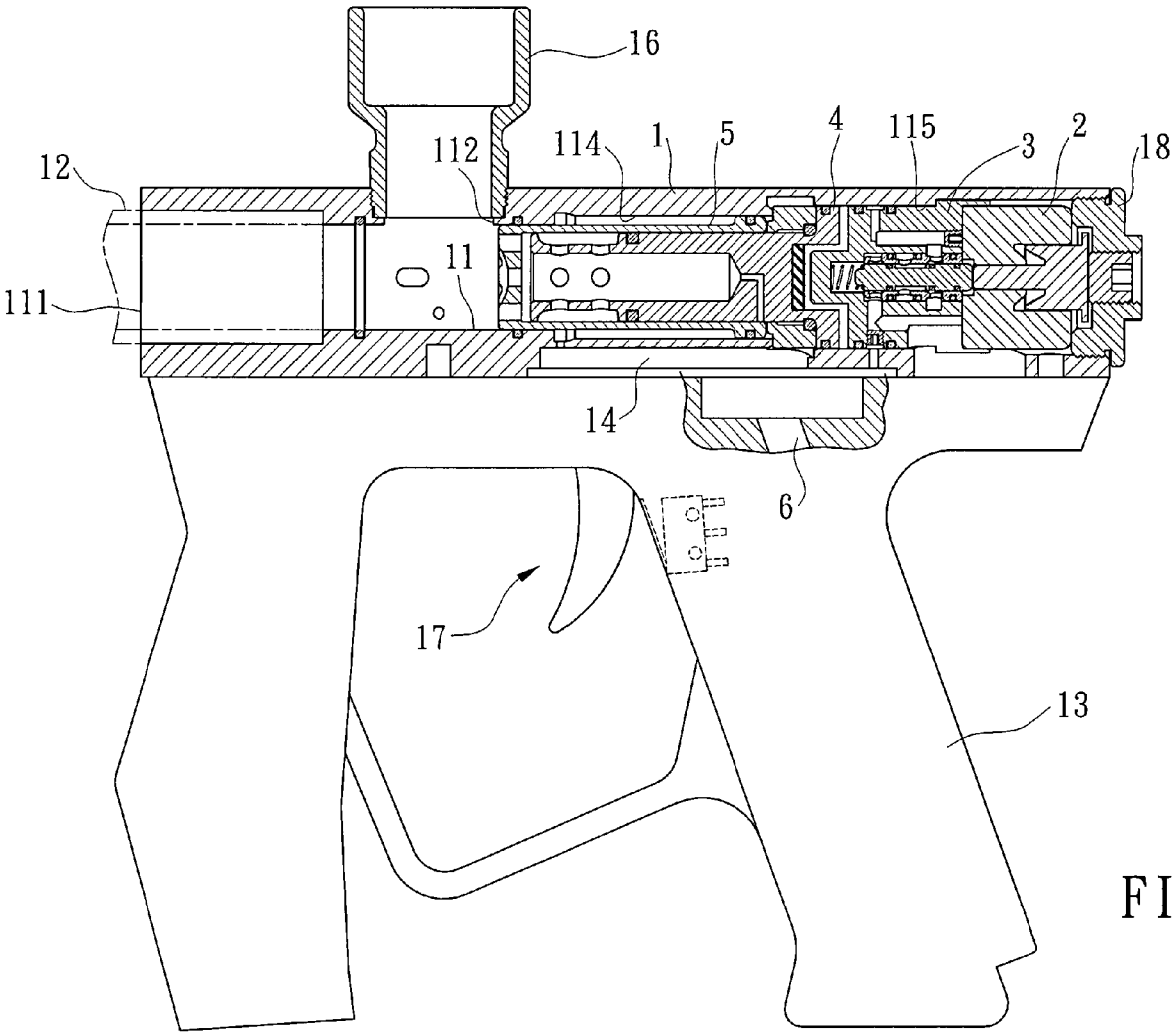
FIG. 1 is a cross sectional view to show the paintball gun of the present invention.
Figure 2:
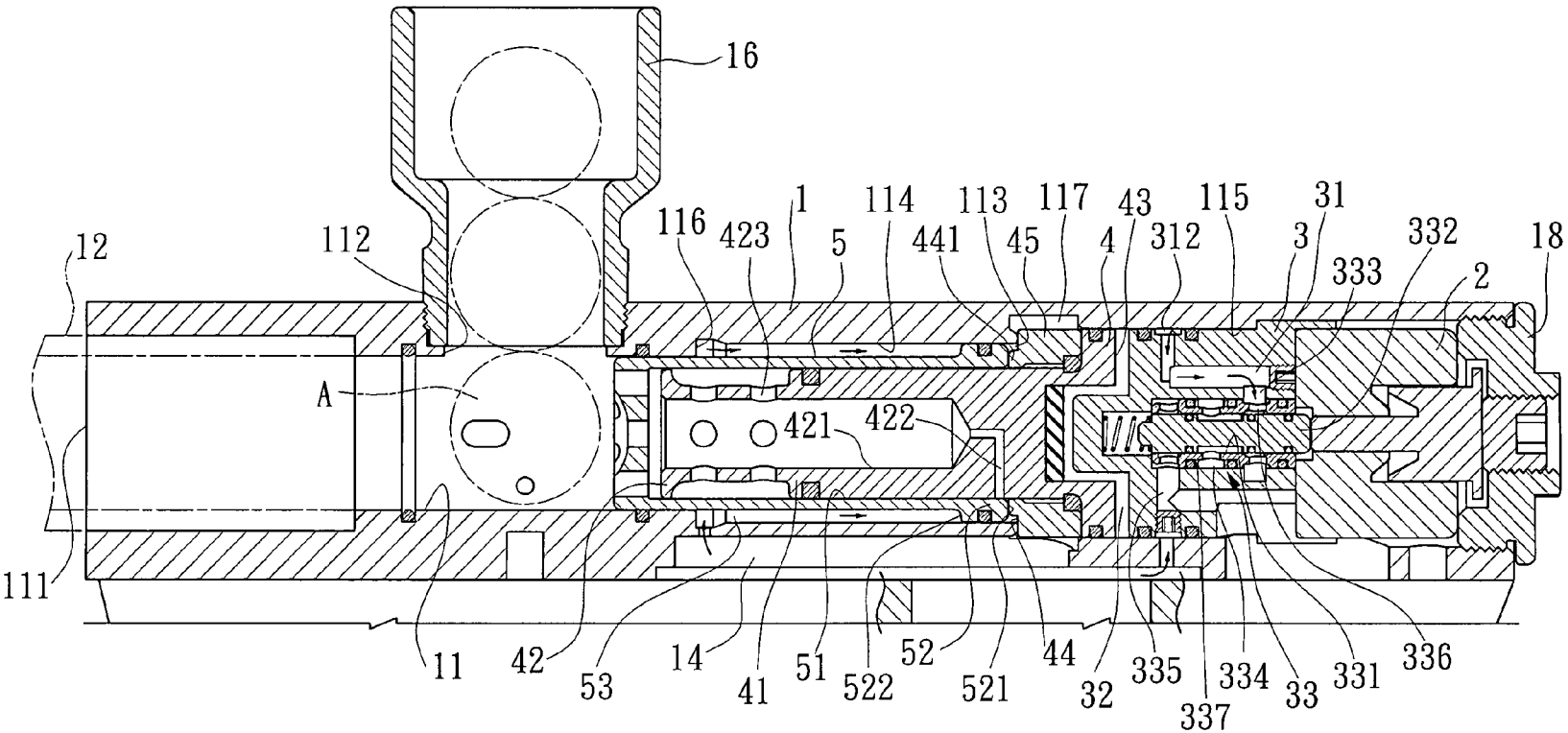
FIG. 2 is an enlarged cross sectional view to show the paintball gun of the present invention.
Figure 3:
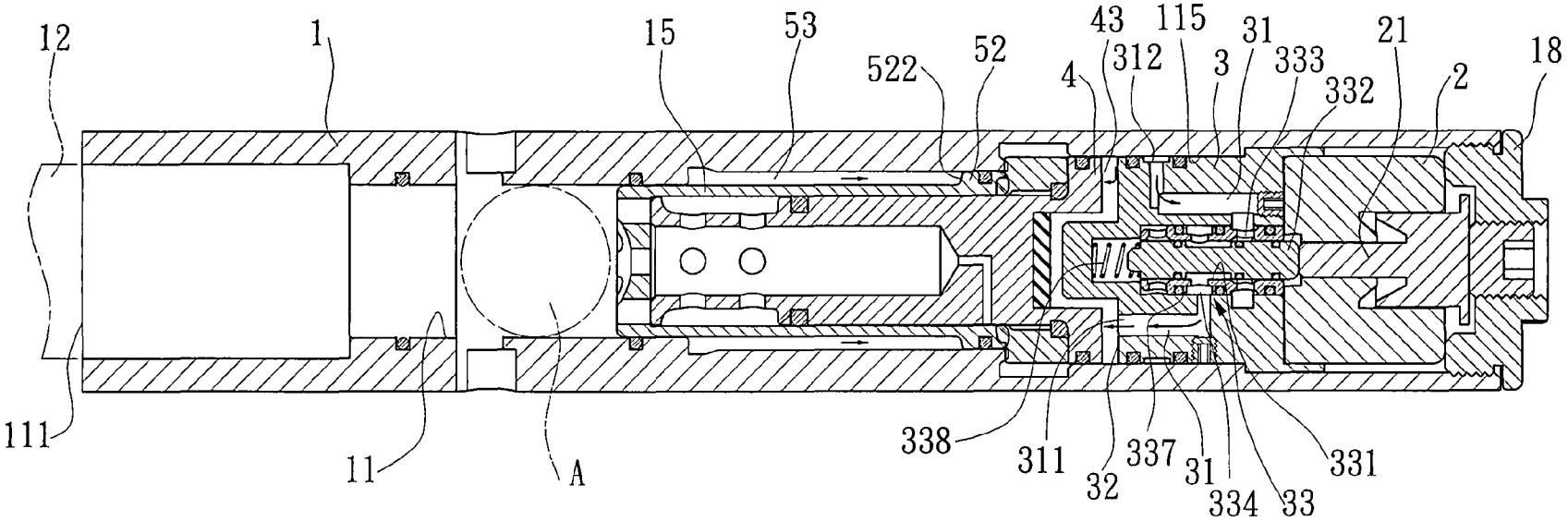
FIG. 3 is a top cross sectional view to show the paintball gun of the present invention.

Referring to FIGS. 1 to 3, the paintball gun of the present invention comprises a barrel 1 having an axial path 11 defined therein and the path 11 includes a closed end and an opening 111 in the other end. A bore 12 is connected with the opening 111. An end cap 18 is connected to the barrel 1 and seals the closed end of the path 11. A paintball inlet 112 communicates with the path 11 and a drop tube 16 is connected to the paintball inlet 112 and paintballs "A" enters the bath 11 via the drop tube 16 and the paintball inlet 112. A first section 114 and a second section 115 are defined in the path 11 and located opposite to the opening 111. The second section 115 has an inner diameter larger than that of the first section 114. A firing mechanism is located in the first and second sections 114, 115 so as to shoot the paintballs "A" in the path 11. A conjunction opening 113 is defined in the conjunction portion between the first and second sections 114, 115. A stop shoulder 116 is defined in an end of the first section 114 and located opposite to the conjunction opening 113. A storage space 14 is defined in a side of the path 11 and a pressurized air source 6 provides pressurized air to be stored in the storage space 14. The storage space 14 communicates with the first and second sections 114, 115. A handle 13 is connected to the barrel 1 and has a trigger 17 which activates the firing mechanism.

The firing mechanism includes a switch member 3, a control member 4 and an inner part 5. The inner part 5 is located in the first section 114 in the path 11 and movable axially in the path 11. The inner part 5 includes an axial space 51 which has one opening end communicating with the path 11 and the other open end of the axial space 51 communicates with the conjunction opening 113 of the first section 114. A flange 52 extends outward from the inner part 5 and is located beside the conjunction opening 113 and has a first push surface 521 facing the conjunction opening 113 and a second push surface 522 on the opposite side of the first push surface 521 which is stopped by the stop shoulder 116 of the first section 114. The first push surface 521 has an area larger than that of the second push surface 522. The flange 52 defines an annular space 53 between an outer periphery of the inner part 5 and an inner periphery of the first section 114. The annular space 53 communicates with the storage space 14 and the conjunction opening 113 communicates with the storage space 14.

The control member 4 is located in the second section 115 of the path 11 and movable axially in the path 11. A chamber 117 is defined in the second section 115 and communicates with the storage space 14. The control member 4 has a guide protrusion 41 extending toward the axial space 51. The guide protrusion 41 includes an air guide end 42 on one end to guide air into the axial space 51. The guide protrusion 41 of the control member 4 includes an air path 421 and a release path 422. The air path 421 communicates with air holes 423 defined through a wall of the control member 4 and the air holes 423 communicate with the axial space 51. The release path 422 communicates with outside of the guide protrusion 41 so as to release the surplus air to outside of the marker. The control member 4 has an end surface 43 facing the switch member 3 and the other side of the end surface 43 is a stop surface 44 which seals or opens the conjunction opening 113. A buffering member 45 is located in the second section 115 and between the inner part 5 and an opposite side of the end surface 43 of the control member 4. The buffering member 45 has a stop surface 44 facing the inner part 5. A convex 441 extends from the stop surface 44 and toward the first section 114 so that air in the chamber 117 enters into the first section 114 via a gap around the convex 441.

The switch member 3 is fixed to the second section 115 and faces the end surface 43 of the control member 4. The switch member 3 includes an air path 31 which has one end communicating with an end surface 32 of the switch member 3. The end surface 32 of the switch member 3 faces the end surface 43 of the control member 4 and forms a first end 311. The other end of the air path 31 communicates with the storage space 14 and forms a second end 312. The air path 31 controls the first end 311 to be opened or closed. The pressurized air in the storage space 14 flows through the air path 31 via the second end 312 and flows out from the first end 311 of the end surface 32 so as to push the control member 4 axially. In this embodiment, the switch member 3 includes a valve 33 to control the air path 31. The switch member 33 is driven by a driving member 2 and a central space 331 is defined in the mediate portion of the air path 31. The central space 331 includes a valve rod 332 received therein, and the central space 331 includes a first passage 333, a second passage 334 and an escape path 335. The first passage 333 communicates with the second end 312 of the air path 31 so as to introduce air in the storage space 14 into the central space 331. The second passage 334 communicates with the first end 311 of the air path 31 so as to introduce air in the central space 331 to flow out from the first end 311. The escape path 335 communicates with outside of the barrel 1 to escape air therefrom. The valve rod 332 includes a first seal 326 located between the first and second passages 333, 334. A second seal 337 is mounted on the valve rod 332 and located beside the escape path 335. The valve rod 332 is driven by the driving member 2 and moves axially. The first seal 336 seals a communication between the first and second passages 333, 334. The second seal 337 seals the escape path 335. In this embodiment, the driving member 2 is an electro-magnetic member which controls a driving pin 21 and the driving pin 21 contacts against the valve rod 332. A spring 338 is connected to an end of the valve rod 332 and the other end of the valve rod 332 contacts the driving pin 21. The driving member 2 is controlled by the trigger 17.

As shown in FIGS. 2 and 3, the paintball gun is ready to shoot, the first seal 336 of the valve rod 332 of the switch member 3 opens the communication between the first and second passages 333, 334, the pressurized air in the storage space 14 flows out from the second end 312 via the first end 311 of the air path 31 so as to push the end surface 43 such that the control member 4 is moved. The stop surface 44 of the control member 4 seals the conjunction opening 113 of the first section 114, and the air in the annular space 53 pushes the second push surface 522 of the flange 52 so that the inner part 5 is moved backward and the paintball inlet 112 is opened. One paintball "A" enters into the path 11 via the paintball inlet 112.

Figure 4:
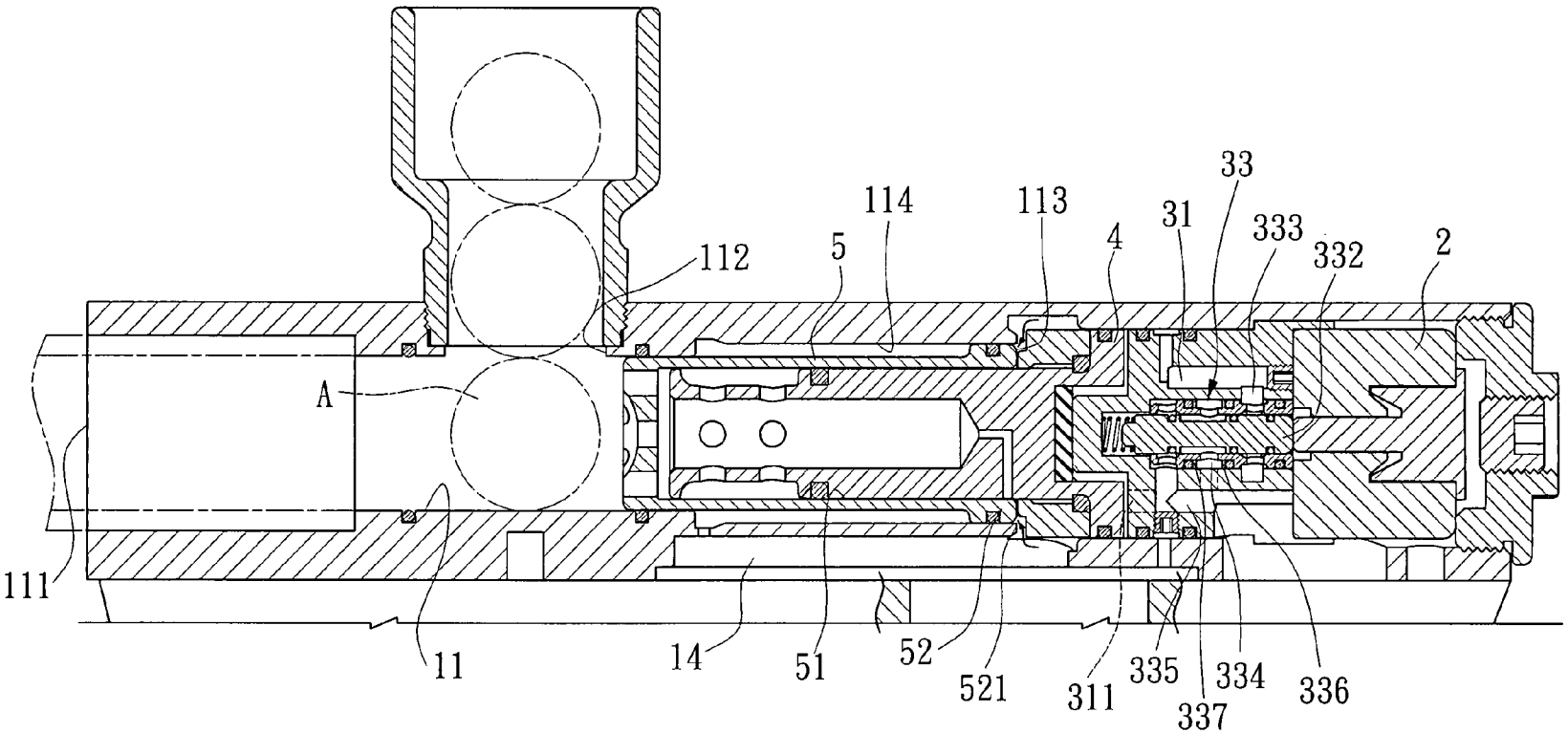
FIG. 4 is a top cross sectional view to show that the paintball enters in the path of the barrel and ready to shoot.
Figure 5:
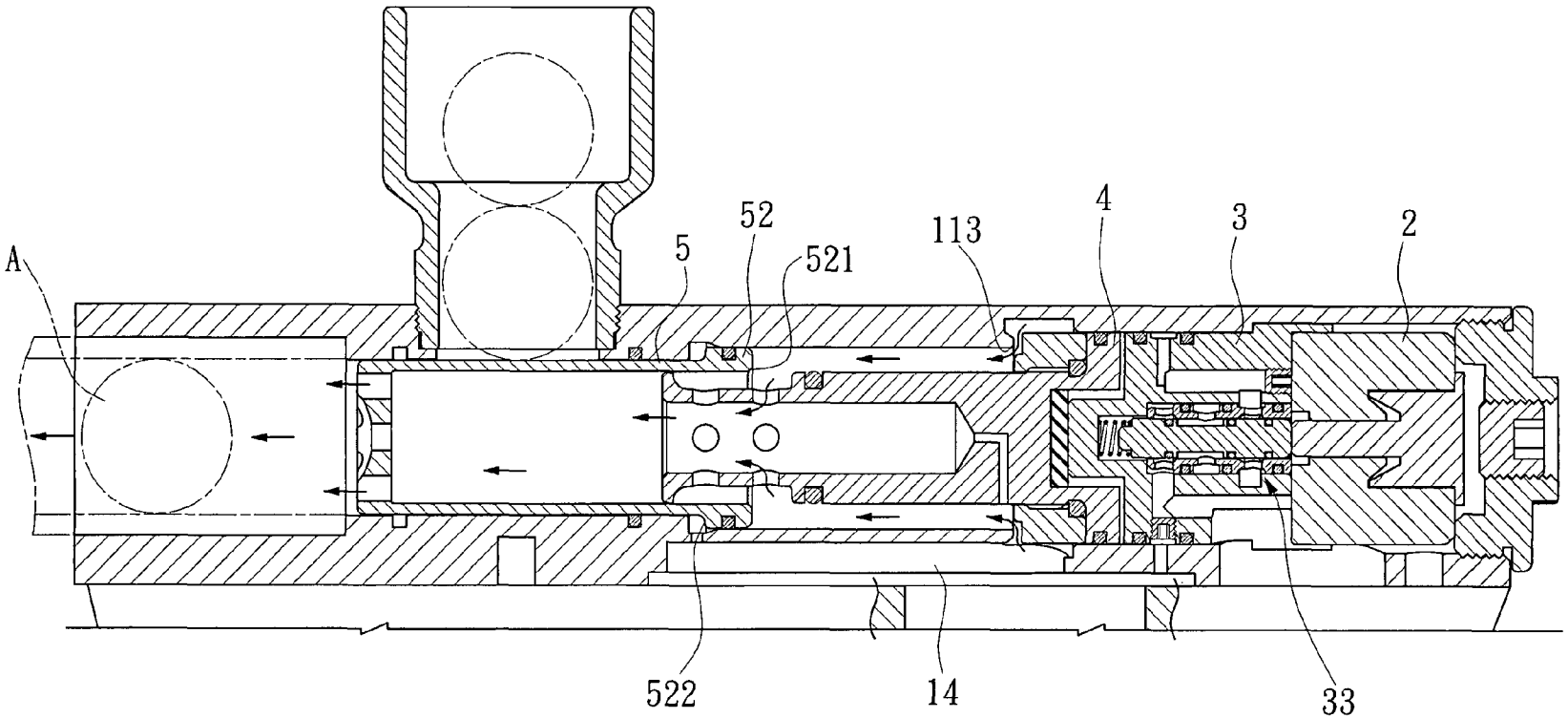
FIG. 5 is a top cross sectional view to show that the paintball is ejected by the inner part.

As shown in FIG. 4, when pulling the trigger 17, the driving member 2 drives the valve rod 332 to move and the first seal 336 opens the communication between the first and second passages 333, 334 so that the air cannot flow out from the first end 311. The second seal 337 opens the escape path 335 to escape the air pushed by the movement of the control member 4. The pressure on the end surface 43 of the control member 4 disappears and the control member 4 moves backward by the pressure in the storage space 14 and the force applied by the inner part 5. The conjunction opening 113 of the first section 114 is then opened and the pressurized air in the storage space 14 enters into the first section 114. The pressure of the air pushes the first push surface 521 of the inner part 5 which moves toward the opening 111 of the path 11 to close the paintball inlet 112. As shown in FIG. 5, the air in the first section 114 enters into the axial space 51 so as to eject the paintball "A" in front of the inner part 5.

The area of the first push surface 521 is larger than that of the second push surface 522, the pressure on the first push surface 521 is larger than that on the second push surface 522, so that the inner part 5 is pushed forward. The air in the annular space 53 located around the inner part 5 is sent back to the storage space 14 by the second push surface 522.

Figure 6:
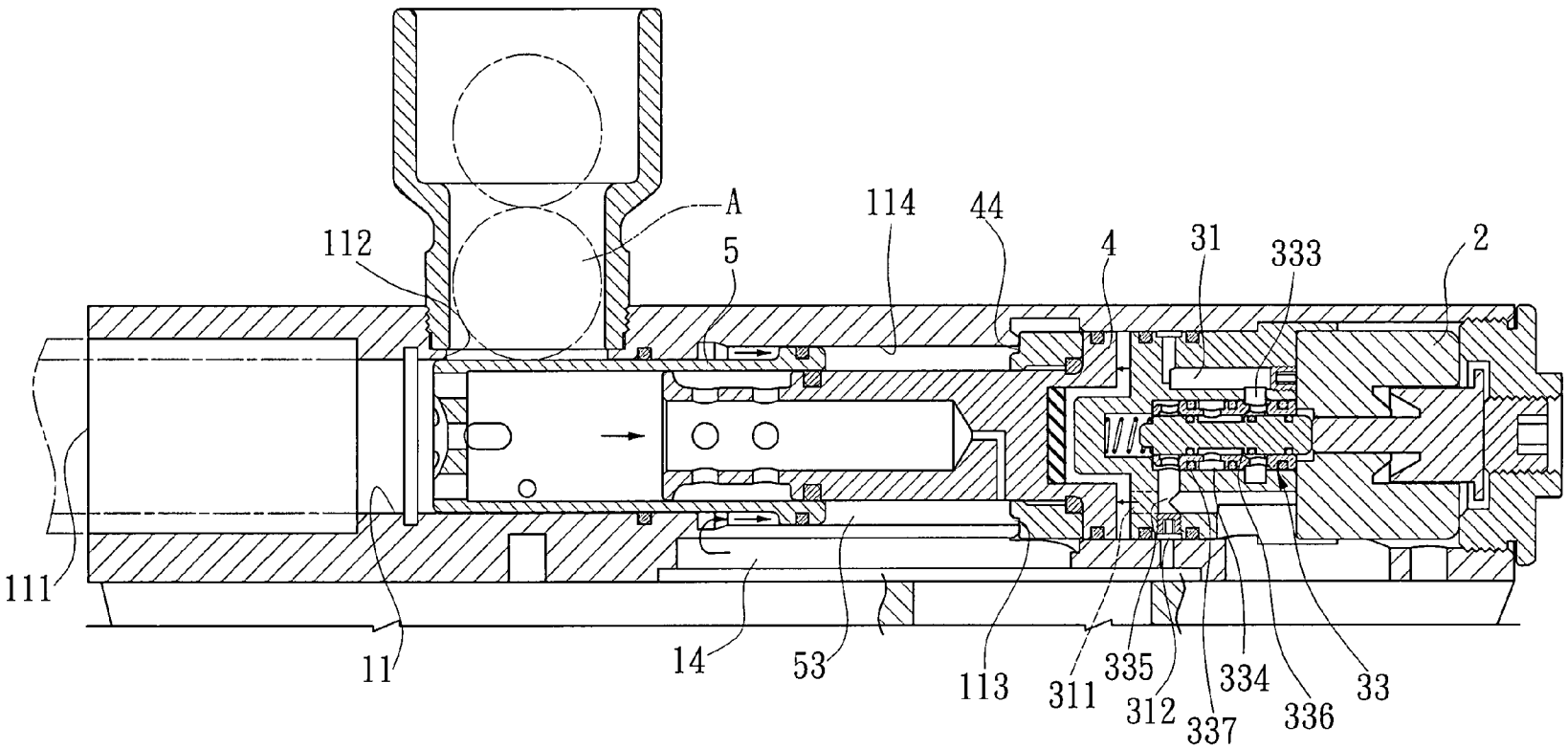
FIG. 6 is a top cross sectional view to show that inner part moves backward and another paintball enters in the path of the barrel and ready to shoot.
Figure 7:
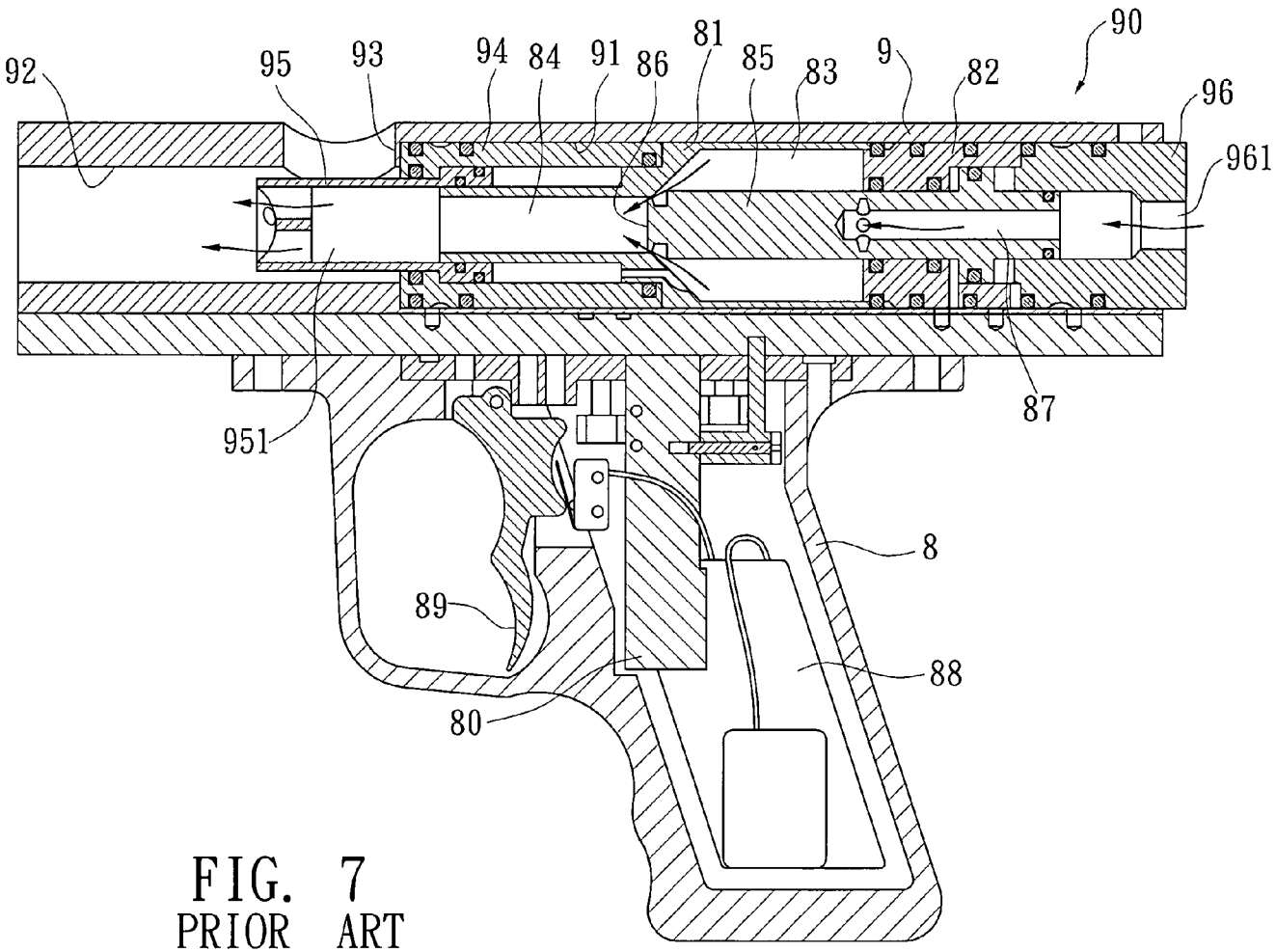
FIG. 7 PRIOR ART
FIG. 7 is a cross sectional view to show a conventional paintball gun.

After the paintball "A" is ejected, the valve rod 332 of the switch member 33 moves back to its initial position and the first seal 336 opens the communication between the first and second passages 333, 334, and the second seal 337 closes the escape path 335. The pressurized air in the storage space 14 can enter from the first end 311 and flow out from the second end 312 to move the control member 4 whose stop surface 44 seals the conjunction opening 113 of the first section 114 and the air in the annular space 53 moves the inner part backward again to allow another paintball "A" drop into the path 11 via the paintball inlet 112 as shown in FIG. 6. When the inner part 5 moves backward, the air will escape from the release path 442.

The pressurized air for activating the inner part 5 and the control member 4 comes from the same storage space 14 so that the paintball gun can be a compact paintball gun. No complicated paths or valves are needed and a simple switch member is used to switch the inner part and the control member.

The air located around the inner part 5 is sent back to the storage space 14 by the second push surface 522 of the flange 52 of the inner part 5 when the inner part 5 is moved forward. The air can be saved and increases the number shoots.

The control member 4 is supported by the inner periphery of the second section 115 and the guide protrusion 41 of the control member 4 is supported by the inner part 5 so that the control member 4 can precisely seal the conjunction opening 113.

The control member 4 also supports the movement of the inner part so as to reduce the axial length of the barrel 1. This makes the paintball gun to be compact and can be used as a hand gun.

While we have shown and described the embodiment in accordance with the present invention, it should be clear to those skilled in the art that further embodiments may be made without departing from the scope of the present invention.

What is claimed is:

1. A paintball gun comprising:

a barrel having an axial path defined therein and the path including a closed end and an opening in the other end, a bore connected with the opening, a paintball inlet communicating with the path, a first section and a second section defined in the path and located opposite to the opening, the second section having an inner diameter larger than that of the first section, a firing mechanism located in the first and second sections, a conjunction opening defined in the conjunction portion between the first and second sections, a stop shoulder defined in an end of the first section and located opposite to the conjunction opening, a storage space defined in a side of the path and a pressurized air source providing pressurized air to be stored in the storage space, the storage space communicating with the first and second sections, a handle connected to the barrel and having a trigger which activates the firing mechanism;

the firing mechanism including a switch member, a control member and an inner part, the inner part located in the first section in the path and movable axially in the path, the inner part including an axial space which has one opening end communicating with the path and the other open end of the axial space communicates with the conjunction opening of the first section, a flange extending outward from the inner part and located beside the conjunction opening and having a first push surface facing the conjunction opening and a second push surface on the opposite side of the first push surface which is stopped by the stop shoulder of the first section, the first push surface having an area larger than that of the second push surface, the flange defining an annular space between an outer periphery of the inner part and an inner periphery of the first section, the annular space communicating with the storage space, the conjunction opening communicating with the storage space;

the control member located in the second section of the path and movable axially in the path, the control member having a guide protrusion extending toward the axial space, the guide protrusion including an air guide end on one end to guide air into the axial space, the control member having an end surface facing the switch member and the other side of the end surface being a stop surface which seals or opens the conjunction opening, and the switch member fixed to the second section and facing the end surface of the control member, the switch member including an air path which has one end communicating with an end surface of the switch member, the end surface of the switch member facing the end surface of the control member and forming a first end, the other end of the air path communicating with the storage space and forming a second end, the air path controlling the first end to be opened or closed.

2. The paintball gun as claimed in claim 1, wherein an end cap is connected to the barrel and seals the closed end of the path, a drop tube is connected to the paintball inlet and paintballs enters the bath via the drop tube and the paintball inlet, a chamber is defined in the second section and communicates with the storage space.

3. The paintball gun as claimed in claim 1, wherein the guide protrusion of the control member includes an air path and a release path, the air path communicates with air holes defined through a wall of the control member and the air holes communicate with the axial space, the release path communicates with outside of the guide protrusion.

4. The paintball gun as claimed in claim 1, wherein a buffering member is located in the second section and between the inner part and an opposite side of the end surface of the control member, the buffering member has a stop surface facing the inner part, a convex extends from the stop surface and toward the first section so that air in the chamber enters into the first section via a gap around the convex.

5. The paintball gun as claimed in claim 1, wherein the switch member includes a valve to control the air path, the switch member is driven by a driving member and a central space is defined in the mediate portion of the air path, the central space includes a valve rod received therein, the central space includes a first passage, a second passage and an escape path, the first passage communicates with the second end of the air path so as to introduce air in the storage space into the central space, the second passage communicates with the first end of the air path so as to introduce air in the central space to flow out from the first end, the escape path communicates with outside of the barrel to escape air therefrom, the valve rod includes a first seal located between the first and second passages, a second seal is mounted on the valve rod and located beside the escape path, the valve rod is driven by the driving member and moves axially, the first seal seals a communication between the first and second passages.

6. The paintball gun as claimed in claim 5, wherein the driving member is an electro-magnetic member which controls a driving pin and the driving pin contacts against the valve rod, a spring is connected to an end of the valve rod and the other end of the valve rod contacts the driving pin, the driving member is controlled by the trigger.

* * * * *